US007290990B2

(12) United States Patent
Lifson

(10) Patent No.: US 7,290,990 B2
(45) Date of Patent: Nov. 6, 2007

(54) SHORT REVERSE ROTATION OF COMPRESSOR AT STARTUP

(75) Inventor: Alexander Lifson, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 535 days.

(21) Appl. No.: 10/443,212

(22) Filed: May 22, 2003

(65) Prior Publication Data

US 2003/0194330 A1 Oct. 16, 2003

Related U.S. Application Data

(63) Continuation-in-part of application No. 09/092,368, filed on Jun. 5, 1998, now Pat. No. 6,648,604.

(51) Int. Cl.
*F04B 19/24* (2006.01)

(52) U.S. Cl. ..... 417/53; 417/325; 417/326

(58) Field of Classification Search ..... 417/325, 417/326, 53, 13

See application file for complete search history.

(56) References Cited

U.S. PATENT DOCUMENTS 2,106,685 A * 1/1938 Smith ..... 417/325
2,976,807 A * 3/1961 Hill ..... 417/325
3,339,829 A * 9/1967 Connor ..... 417/44.3
4,382,370 A * 5/1983 Suefuji et al. ..... 62/324.1
4,905,478 A * 3/1990 Matsuda et al. ..... 62/244
5,076,067 A * 12/1991 Prenger et al. ..... 62/197
5,310,326 A * 5/1994 Gui et al. ..... 418/76
5,395,214 A * 3/1995 Kawahara et al. ..... 417/53
5,820,349 A * 10/1998 Caillat ..... 417/44.11
6,210,119 B1 * 4/2001 Lifson et al. ..... 417/18
6,264,445 B1 * 7/2001 Beck et al. ..... 418/55.5
6,280,146 B1 * 8/2001 Bush et al. ..... 417/13
6,478,556 B2 * 11/2002 Choi et al. ..... 418/55.2
6,648,607 B2 * 11/2003 Milliff et al. ..... 417/228
2002/0150490 A1 * 10/2002 Bush et al. ..... 418/55.1
2003/0077193 A1 * 4/2003 Skinner ..... 418/55.1
2004/0022658 A1 * 2/2004 Narasipura et al. ..... 418/55.1
2004/0161345 A1 * 8/2004 Choi et al. ..... 417/298
2004/0208766 A1 * 10/2004 Jeong ..... 418/55.5

OTHER PUBLICATIONS

Hicks et al. Pump Application Engineering, 1971, McGraw-Hill, Inc., pp. 31-38.*

* cited by examiner

*Primary Examiner*—William H. Rodriguez
(74) *Attorney, Agent, or Firm*—Carlson, Gaskey & Olds

(57) ABSTRACT

In a method of operating a scroll or screw compressor at startup, the compressor is rotated in reverse for a brief period of time. The compressor is of a type that does not compress liquid when rotated in reverse. The purpose is to boil off the liquid refrigerant from the oil by heating and agitating the mixture of oil and refrigerant in the oil sump. This results in much more benign forward start as no refrigerant is drawn into the scroll compressor pump and the amount of oil pumped out of the compressor on start up is minimized. Also, the viscosity of oil is increased and lubrication of the bearings is improved. After a short period of time reverse rotation is stopped and the compressor can begin to be driven in the forward direction.

9 Claims, 2 Drawing Sheets

SHORT REVERSE ROTATION OF COMPRESSOR AT STARTUP

This application is a continuation-in-part of U.S. patent application Ser. No. 09/092,368 filed on Jun. 5, 1998.

BACKGROUND OF THE INVENTION

This invention relates to a unique method of minimizing the detrimental effect of scroll or screw compressors flooded starts.

Scroll compressors are widely utilized in refrigerant compressor operation. One known type of scroll compressor includes compression elements and an electric motor housed within a sealed compressor shell. A quantity of lubricant is also received in the compressor shell. In such compressors, the refrigerant passes over the motor on its way to the inlet of the compression elements, cooling the motor.

In a scroll compressor a pair of scroll members have wraps which interfit with each other to define compression chambers. When rotated in a forward direction, a normal compression process occurs in which refrigerant is trapped between the wraps and compressed towards a discharge port.

At startup the oil, located in a compressor sump, may contain a quantity of liquid refrigerant. At startup the sump and motor are cool, and preheating does not occur. The presence of the unpreheated oil/refrigerant mixture in the oil sump has undesirable effects.

The problem is particularly acute in refrigerant systems for intermodal transport, here refrigeration takes place in large containers used to transport fruit or other food products over long distances. Inter-modal refrigerant containers may be initially shipped on a boat, transferred to a train, and then transferred to trucks. Refrigeration must be maintained throughout the entire trip. The container may then be returned to a remote location for storage. Thus, during its life cycle a container refrigeration system may often be shut down for long periods of time.

The problem can become especially severe during cold starts. When the refrigeration system is shut down, under certain ambient conditions, large portions of liquid refrigerant contained in the system can migrate to the compressor sump. Thus oil located in the compressor sump can be diluted with liquid refrigerant. This is undesirable because on startup it can result in liquid refrigerant passing through the scroll elements. This can result in bearing and scroll element damage. Also oil dilution by the refrigerant may lead to lower lubricant viscosity, which is also detrimental to bearing life.

Crank-case heaters have been proposed to address this problem. Crank-case heaters are turned on prior to startup of the compressor to preheat the sump of the compressor and begin to address the problems discussed above.

However, crank-case heaters require a long time to heat the oil and refrigerant mixture. Thus, the heaters must be turned on for a relatively long period of time before the compressor can be started. In addition, a crank-case heater is relatively expensive, and presents its own reliability problems.

SUMMARY OF THE INVENTION

In a disclosed method of the present invention, a scroll compressor is operated in reverse at startup. When operated in reverse, the refrigerant is not compressed and is not moved through the compression elements. Thus, the motor heat is not removed by refrigerant vapor. The motor is immersed in the oil/refrigerant mixture and thus quickly heats this mixture. Refrigerant trapped in the sump is then boiled off and oil temperature is increased.

Additional beneficial boiling off of refrigerant takes place as the oil/refrigerant mixture has been agitated by the electric motor rotor and rotor counterweight, rotating in the oil/refrigerant mixture. After a short period of time reverse rotation is stopped, and the motor is rotated in a forward direction and normal compression begins. However, the oil is now preheated and there is less liquid refrigerant in the oil.

The invention applies to compressors that have a rotary electric motor. In a most preferred embodiment of this invention, the compressor is a scroll compressor. In an alternate embodiment, the invention is used as a screw compressor. In addition, the present invention is most preferably used on an intermodal container refrigerant system. In such systems large fans mask any undesirable noise from the reverse rotation.

These and other features of the present invention can be best understood from the following specification and drawings, of which the following is a brief description.

DETAILED DESCRIPTION OF A PREFERRED EMBODIMENT

Figure 1:
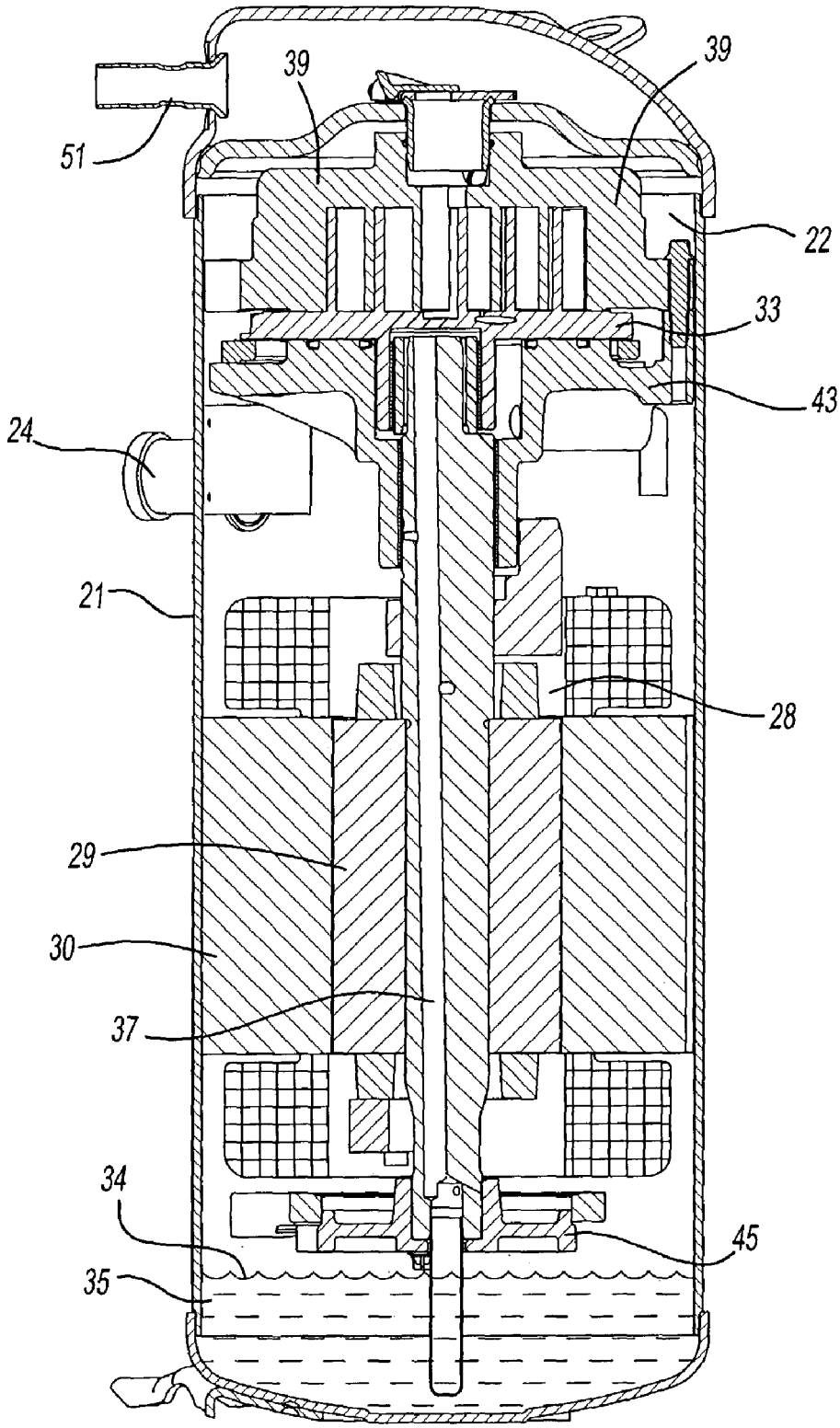
FIG. 1 is a view of the scroll compressor incorporated into the present invention.

FIG. 1 shows a compressor 20 for practicing the present invention. As shown, a sealed compressor shell 21 receives a compressor pump unit 22 consisting of fixed scroll 39, orbiting scroll 33, and crankcase 5. An outlet 26 is formed at a location sealed from the inlet 24. A motor 28 is positioned in the sealed compressor shell 21, and has its rotor 29 spaced from its stator 30. The motor drives a shaft 32 which in turn drives the orbiting scroll 33 of a scroll compressor.

As shown, oil 34 fills the oil sump 35 and the bottom of rotor 29 and shaft 32 rotate within the oil sump. As known, oil travels up a passage 37 within the shaft 32 to lubricate bearings, and fixed 39 and orbiting scroll 33. The fixed scroll is supported by crankcase 43 and the shaft is supported axially by lower bearing ring 45.

During normal operation, the rotor and shaft rotate in a forward direction and the scroll compressor compresses fluid. Fluid enters the compressor shell 21 through inlet 24 and part of the fluid passes over the motor preheating the gas leading into the inlet of the compressor. Another portion of the fluid is delivered directly to the compressor pump 22. The compressor as described until now is as known in the prior art.

Figure 2:
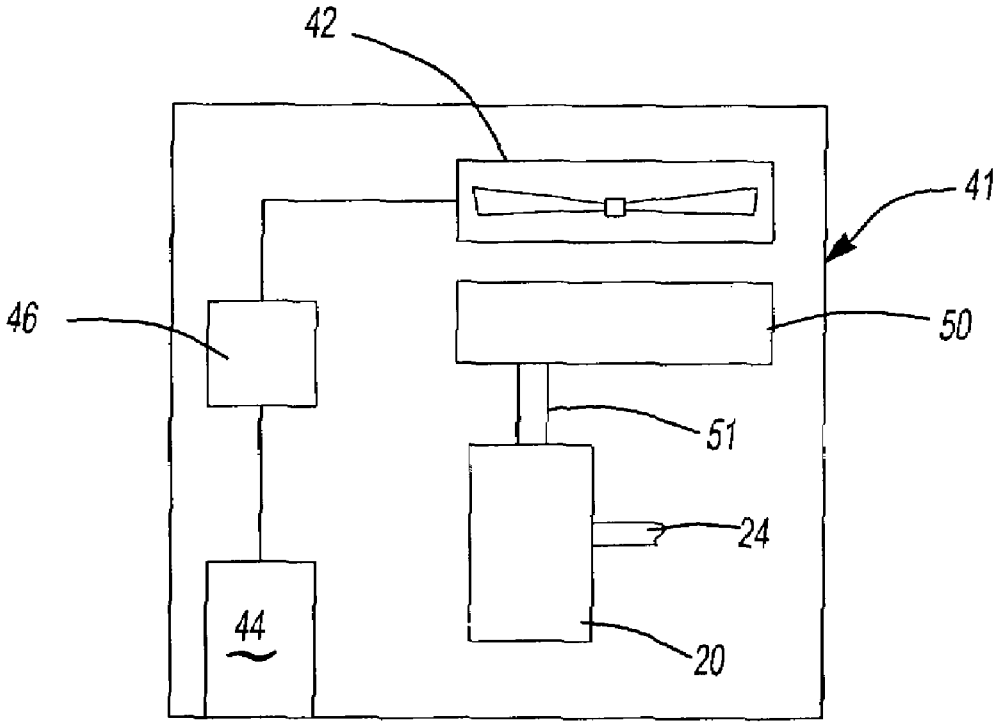
FIG. 2 is a schematic view of a refrigerated container.

FIG. 2 shows a front view of refrigeration system 41 which may be utilized for intermodal refrigerated transportation The refrigerant system 41 includes a fan 42, compressor 20, and condenser 50 connected to compressor discharge line 51. A control 44 controls the fan and compressor motor. Further, the control communicates with a known phase reversing unit 46 which is capable of reversing the phase of the power input to the motor to result in reverse rotation. Other methods of achieving reverse rotation may also be utilized.

Upon startup of compressor 20, the oil 34 may include a relatively large amount of liquid refrigerant. In addition oil 34, and motor 28 are both relatively cool.

When the compressor is started in a forward direction, without being run prior to this in reverse direction, suction pressure decreases rapidly and foaming of refrigerant and oil mixture occurs. This results in a liquid mixture of refrigerant and oil being ingested with incoming vapor into the compressor pump unit 22. The ingestion of liquid into pump unit 22 can lead to damage to the scroll compressor wraps. Also, oil pump out from the sealed compressor shell can occur, as the mixture of oil and refrigeration may leave the compressor. That is, the amount of oil can be partially depleted. This can result in bearings and scroll compressor wrap damage due to lack of lubrication upon startup.

In the present invention, when it is desired to start the compressor; the control 44 begins to operate motor 28 in reverse. When the orbiting scroll member moves in reverse relative to the fixed scroll member, fluid is not compressed and the mixture of oil and refrigerant is not drawn into pump element 22. In addition, during reverse rotation, torque is low since no refrigerant is being compressed. The pump elements are not overstressed, bearing loads, coupling loads and flank loads are minimal, and thus wear of components at startup is minimized. Thus, there is no ingestion of the liquid mixture and no damage done to scroll compressor wraps. The oil also stays in the compression sump. Refrigerant vapor is not being driven through the compressor, as no refrigerant is being pulled into the inlet 24. The motor is thus not cooled by incoming refrigerant gas and heats up quickly.

The heat generated by the motor is dissipated into the oil sump and causes oil 34 to quickly heat up. This causes refrigerant in the oil to boil off. Boiling off of refrigerant from the oil is additionally enhanced by agitating the mixture of oil and refrigerant by rotor and shaft rotation in the mixture. After a short transient period of reverse rotation (such as on the order of 15 seconds to four minutes) reverse rotation is stopped. In fact, in many systems the fans are turned on a short period of time (i.e. 45 seconds) prior to compressor start up in the forward direction. Thus, the compressor reverse rotation can occur during the fan startup. Thus, the reverse rotation may not delay refrigerant system startup at all. After completing the reverse rotation, rotation in the forward direction may then begin.

When the rotation in forward direction begins, shortly after the compressor has been operated in reverse, there is much less liquid refrigerant in the oil than would have been if no prior reverse rotation has taken place. Thus the mixture of oil and refrigerant is not drawn into the pump unit and the oil does not leave the compressor shell case. Also as a substantial amount of refrigerant has been boiled off from the oil, the viscosity of the oil is increased, which is beneficial to bearing lubrication. Thus potential damage to compressor is minimized. Further, it may only be necessary to use reverse rotation under certain conditions. As an example, reverse rotation may only be necessary when shut down time exceeds a minimum value. Also, if ambient temperatures is above a minimum, reverse rotation may not be necessary. It should be noted that the length of reverse rotation should typically be limited to a few minutes of operation. Prolonged operation of scroll compressor in reverse can lead to motor and scroll wrap damage due to overheating.

Although the invention is specifically disclosed in a scroll compressor for intermodal transportation it may have application to other refrigeration, heat pump or air conditioning compressors. Also, the invention has application to other types of compressors with preferential direction of rotation.

Figure 3:
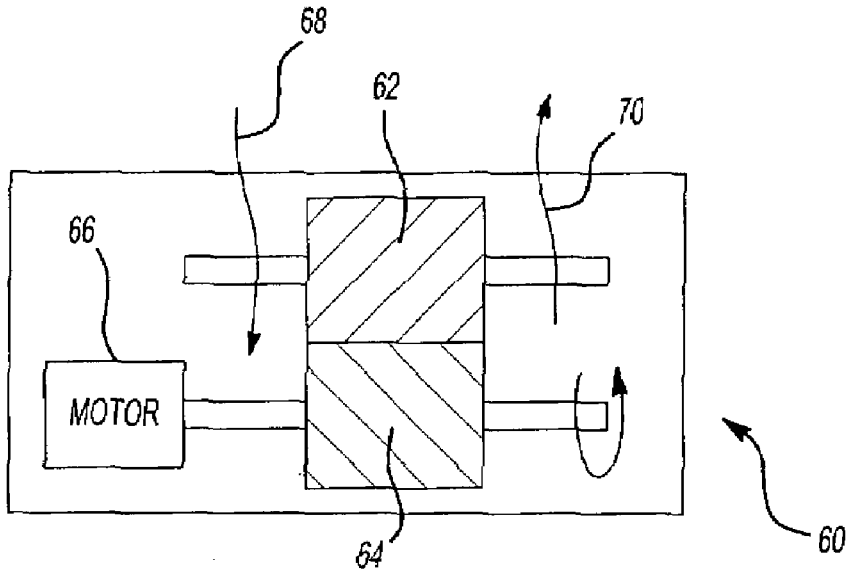
FIG. 3 is a view of a screw compressor.

FIG. 3 shows a screw compressor 60 schematically. As known, a pair of intermeshed screw rotors 62 and 64 define compression chambers. A motor 66 drives one of the screw compressor elements 64. An inlet or suction line 68 delivers a refrigerant which is compressed by the intermeshing screws 62 and 64 and which is delivered to an outlet 70. This type of compressor is generally similar to a scroll compressor in that there is not effective compression when the rotor is driven in a reverse direction. Thus, it is atypical and contrary to standard screw compressor design to drive the compressors in anything other than its normal operational direction. However, within the context of this invention, some short driving in the reverse direction is utilized for the benefit similar to those discussed above. State another way, the rotation is initially began in a first direction for a period of time, then that rotation is stopped, and rotation begins in a second opposed direction.

In a preferred embodiment, the reverse rotation begins immediately once the determination is made that it would be desirable. However, it is within the scope of this invention that other tactics occur first. As an example, it may well be that a compressor designer would choose to have a very short period of normal forward drive before the reverse drive at startup for any one of several reasons. However, the use of the reverse drive as part of the "startup" process would bring such operation within the scope of this invention, and within the scope of the claims.

A preferred embodiment of this invention has been disclosed, however, a worker of ordinary skill in the art would recognize that certain modifications come within the scope of this invention. For that reason the following claims should be studied to determine the true scope and content of this invention.

The invention claimed is:

1. A method of operating a compressor comprising the steps of:

(a) providing a compressor including a motor and a screw compressor pump unit;

(b) determining that startup of the compressor is desirable;

(c) intentionally rotating said motor and said pump unit in a first direction for a period of time; and (d) stopping rotation in said first direction and beginning rotation in a second opposed direction, (e) said sealed compressor is of the type wherein a fluid passes into a sealed compression shell and cools said motor as it is driven to an inlet of said pump unit, such that during rotation in said first direction, said fluid is not effectively passed over said motor and said motor heats quickly.

2. A method as recited in claim 1, wherein step (c) occurs once the determination that startup is desirable is made at step (b).

3. A method as recited in claim 1, wherein said motor and said pump unit are all part of an air conditioning system.

4. A method as recited in claim 1, wherein said motor and said pump unit are all part of a heat pump.

5. A method of operating a compressor comprising the steps of:

(a) providing a compressor including a motor and a screw compressor pump unit;

(b) determining that startup of the compressor is desirable;

(c) intentionally rotating said motor and said pump unit in a first direction for a period of time; and (d) stopping rotation in said first direction and beginning rotation in a second opposed direction, (e) motor and said pump unit are all part of a refrigerant system on a refrigerated transport container.

6. A method as recited in claim 5, wherein said sealed compressor is of the type wherein a fluid passes into a sealed compression shell and cools said motor as it is driven to an inlet of said pump unit, such that during rotation in said first direction, said fluid is not effectively passed over said motor and said motor heats quickly.

7. A method of operating a compressor comprising the steps of:

(a) providing a compressor including a motor and a screw compressor pump unit;

(b) determining that startup of the compressor is desirable;

(c) intentionally rotating said motor and said pump unit in a first direction for a period of time; and (d) stopping rotation in said first direction and beginning rotation in a second opposed direction, (e) a second determination is made at step (b) to decide if step (c) is necessary, and only performing step (c) if said second determination finds that step (c) is necessary.

8. A method as recited in claim 7, wherein said second determination is whether the compressor has been shut down for a minimum period of time.

9. A method as recited in claim 7, wherein said second determination is whether ambient temperature is below a minimum.

* * * * *